US007798383B2

(12) United States Patent
Liesse

(10) Patent No.: US 7,798,383 B2
(45) Date of Patent: Sep. 21, 2010

(54) INTERNAL-COMBUSTION GAS-POWERED HAND TOOL

(76) Inventor: Maurice Liesse, 4 les Logis de la Pie, 94100 Saint Maur les Fosses (FR)

( * ) Notice: Subject to any disclaimer, the term of this patent is extended or adjusted under 35 U.S.C. 154(b) by 99 days.

(21) Appl. No.: 12/089,723

(22) PCT Filed: Oct. 11, 2006

(86) PCT No.: PCT/IB2006/002839

§ 371 (c)(1),
(2), (4) Date: May 13, 2008

(87) PCT Pub. No.: WO2007/042915

PCT Pub. Date: Apr. 19, 2007

(65) Prior Publication Data

US 2008/0251562 A1 Oct. 16, 2008

(30) Foreign Application Priority Data

Oct. 11, 2005 (FR) ..... 05 10378

(51) Int. Cl.
*B25C 1/04* (2006.01)

(52) U.S. Cl. ..... 227/9; 227/10; 123/46 SC

(58) Field of Classification Search ..... 227/8, 227/10, 130, 9; 123/46 SC
See application file for complete search history.

(56) References Cited

U.S. PATENT DOCUMENTS

| | | | | |
|---|---|---|---|---|
| 4,200,213 | A * | 4/1980 | Liesse | 227/10 |
| 4,377,991 | A | 3/1983 | Liesse et al. | |
| 4,712,379 | A * | 12/1987 | Adams et al. | 60/632 |
| 4,773,581 | A * | 9/1988 | Ohtsu et al. | 227/10 |
| 5,213,247 | A * | 5/1993 | Gschwend et al. | 227/10 |
| 6,463,894 | B2 * | 10/2002 | Hasler et al. | 123/46 R |
| 6,892,524 | B1 * | 5/2005 | Van Erden et al. | 60/39.6 |
| 6,912,988 | B2 * | 7/2005 | Adams | 123/256 |
| 2005/0091962 | A1 | 5/2005 | Van Erden et al. | |

FOREIGN PATENT DOCUMENTS

FR 2398587 A 2/1979

OTHER PUBLICATIONS

French Search Report for FR 0510378 dated Jul. 11, 2006.

* cited by examiner

*Primary Examiner*—Scott A. Smith
(74) *Attorney, Agent, or Firm*—Lowe Hauptman Ham & Berner LLP

(57) ABSTRACT

The tool comprises a piston which can be propelled under the action of the explosion of a mixture of gas and air to drive an element, a first, gas-metering chamber, a second, gas-air mixture-preparation chamber, designed to communicate with the first chamber, and a third chamber designed to communicate with the second chamber, which is delimited by the piston and which is a throttling and propulsion chamber.

The invention is ideally applicable to securing tools.

10 Claims, 7 Drawing Sheets

INTERNAL-COMBUSTION GAS-POWERED HAND TOOL

RELATED APPLICATIONS

The present application is based on International Application Number PCT/IB2006/002839filed Oct. 11, 2006, and claims priority from French Application Number 05 10 378filed Oct. 11, 2005, the disclosures of which are hereby incorporated by reference herein in their entirety.

The invention relates originally to an internal-combustion gas-powered securing tool in which a piston is propelled under the action of the explosion of a mixture of gas and air in order, via its rod, to strike a nail, in which case it is a gas-powered nail gun, or some other fastener.

The benefit of gas-powered tools over powder-powered tools is that they can be fired a great many times without the least need for refilling. Hence, there has been a search to optimize the efficiency of these gas-powered tools.

For a certain length of time use is being made of gas-powered tools comprising a first chamber of a first volume comprising means for igniting a fuel gas and generating a flame, a second chamber of a second volume and means for placing the two chambers in communication which means are designed to allow the flame to pass.

Two-chamber tools are already relatively satisfactory. With two chambers, the first is a pre-compression chamber which allows the explosion pressure in the second chamber to be increased, the explosion pressure in a volume being proportional to the pressure of the mixture prior to the explosion. If the second chamber is partially delimited by the drive piston, then by virtue of this pre-compression, the piston will have moved only very slightly forward when the explosion occurs in this second, piston-propulsion, chamber, and this will allow the piston to benefit correctly from the energy of the combustion of the gas.

When, in addition, a fan is provided in the flame-generating chamber, the combustion rate and the maximum pressure level in this chamber are increased, making it possible to reduce the pressure-rise time and, consequently, to further limit the movement of the piston in its drive chamber before the explosion occurs therein, and therefore further increase the power of the tool.

It will be noted that the effect of a boost fan is more than significant; it allows the pressure rise time to be reduced by a factor of the order of 10.

However, and even with a pre-compression chamber, or combustion pre-chamber, full benefit cannot be derived from the energy of combustion of the gas and, as a result, further attempts have been made at increasing the pressure level and combustion rate in the second, drive, chamber and thus at increasing the power of two-chamber tools.

Document FR-A-2 852 547discloses a gas-powered tool comprising a first, fuel-gas pre-compression and flame-generating, chamber, a second, propulsion, chamber, means for placing the two chambers in communication which means are designed to allow the passage of the flame, and a third, intermediate, compression and flame-accelerating, chamber connecting the first and second chambers.

With three chambers, it is certain that at least the entire volume of mixture in the intermediate third chamber is driven into the second, propulsion, chamber in order to increase the pressure therein, the flame generated in the first chamber passing through the inlet and the outlet of the intermediate chamber.

The applicant company has further sought to increase the power of gas-powered tools and it is thus proposing its invention which is an internal-combustion gas-powered securing tool in which a piston can be propelled under the action of the explosion of a mixture of gas and air to strike a fastener, the tool being characterized in that it comprises a first, gas-metering, chamber, a second, gas-air mixture-preparation, chamber, designed to communicate with the first chamber, and a third chamber designed to communicate with the second chamber, which is delimited by the piston and which is a throttling and propulsion chamber.

By virtue of the throttling and propulsion chamber, the efficiency of the combustion in this chamber is considerably enhanced.

The applicant company intends to broaden the scope of its application beyond mere securing tools. Thus, it intends to claim any internal-combustion gas-powered hand tool in which a drive piston can be propelled under the action of the explosion of a mixture of gas and air to drive an element, the tool being characterized in that it comprises a first, gas-metering chamber, a second, gas-air mixture-preparation, chamber, designed to communicate with the first chamber, and a third chamber designed to communicate with the second chamber, which is delimited by the piston and which is a throttling and propulsion chamber.

A securing tool is a special case of hand tool, in which the piston is to drive or strike a fastener. The piston of the hand tool of the invention may be the rod of a ram, for example of secateurs, of a crimping tool, of shears, of a bolt cutter, of a punching tool. The hand tool of the invention could even be a contactless hypodermic syringe.

In the preferred embodiment of the tool of the invention, the second and third chambers are separated by a moving plate for throttling the mixture, advantageously equipped with mixture-passage means comprising means for ejecting the mixture (quasi)tangentially into the third chamber.

As a preference also, there is a three-way directional-control valve in which a gas inlet port and two ports open respectively onto the first, metering, chamber and the second, mixture-preparation, chamber, it being possible for the first chamber to be connected to the gas inlet port or to the second, mixture-preparation, chamber.

Advantageously also, the metering chamber is delimited by a bell-shaped wall mounted to slide, on a fixed plate delimiting the second, mixture-preparation, chamber, against the action of the return means.

In this case and as a preference, the metering chamber is secured to a moving plate fixed to the bell-shaped wall and subjected to the action of the return means.

The invention will be better understood with the aid of the following description of the preferred embodiment of the tool of the invention, with reference to the attached drawing, in which.

Figure 1:
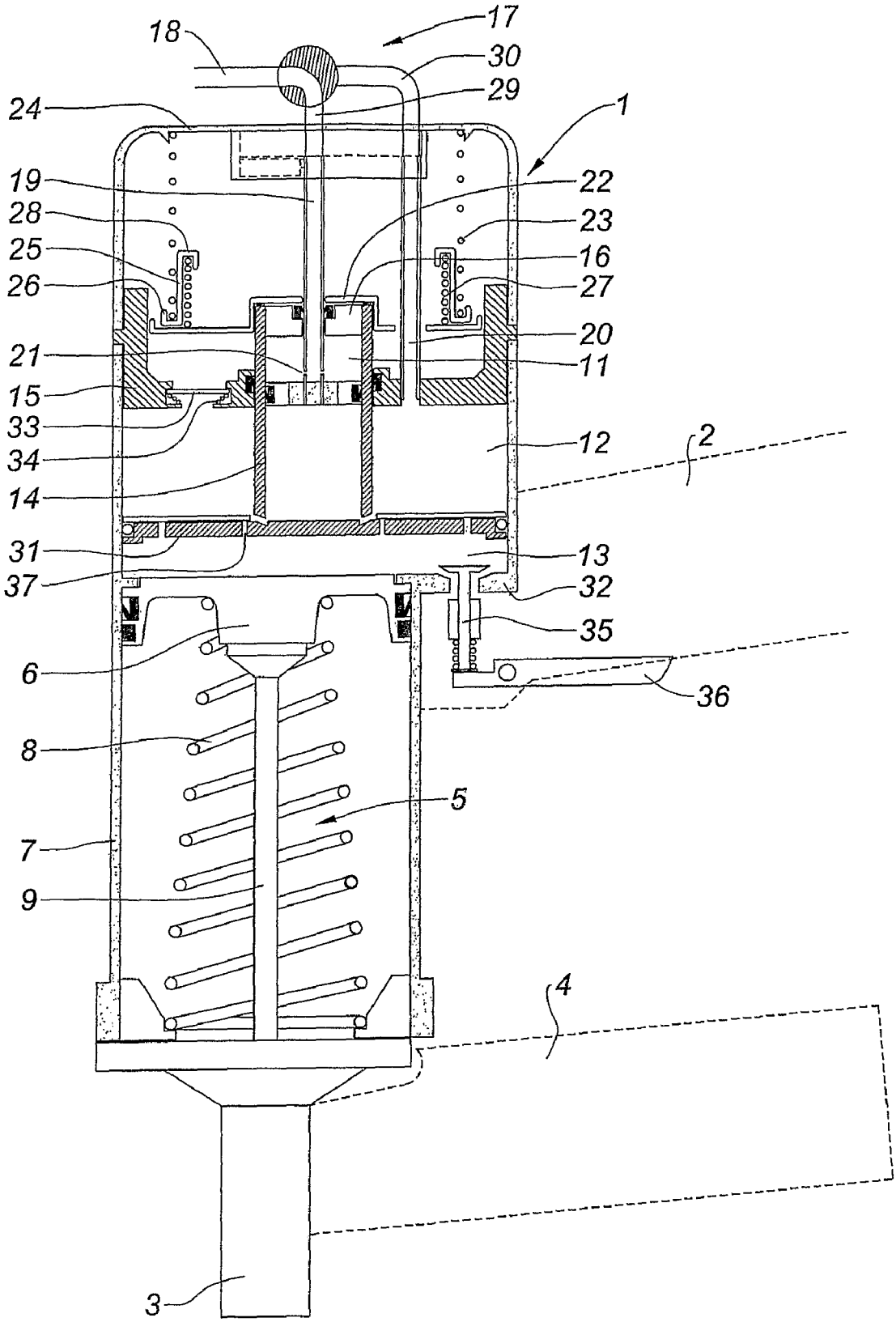
FIG. 1 is a schematic depiction of the tool with three chambers, one for metering, one for mixing and one for throttling, in axial section, while the metering chamber is being filled.

The tool in FIG. 1 is a gas-powered nail gun for driving nails into a material. It comprises a body 1 with an operating and actuating hand grip 2 and, at the bottom, a brad guide 3 and an arm 4 for accepting a strip of nails and for loading the nails into the brad guide. To drive the nails, a piston 5, via its head 6, is mounted to slide in a cylinder 7 against the action of a spring 8. The piston 6 comprises a nail-driving rod 9. The body 1 comprises a housing to accept a cartridge of a fuel gas intended to be injected into a series of combustion chambers before the air-gas mixture is ignited in order to drive the piston 6. The body 1 also comprises an ignition equipment, not depicted, for igniting the mixture in the last, propulsion, chamber 13.

Here, the body 1 has three chambers 11, 12, 13. A first chamber 11, for metering the gas, is delimited by a tubular side wall 14, mounted to slide on a fixed plate 15 separating the first chamber 11 from the second chamber 12. The plate 15 constitutes the downstream transverse wall of the metering chamber 11 and the upstream transverse wall of the second chamber 12. The metering chamber 11 is also delimited by a sleeve 16 of which it constitutes the upstream transverse wall, the side wall 14, combined with the upstream sleeve 16, forming a bell-shaped wall. The sleeve 16 is designed to act as a piston. In the body 1 there is a three-way directional-control valve 17, consisting of an inlet port 18 intended to be connected to the gas cartridge, and two outlet ports 29, 30 connected one to an inlet and delivery pipe 19 for the metering chamber 11 and one to an inlet pipe 20 for the second chamber 12.

The inlet pipe 19 for the metering chamber 11 is mounted on the fixed plate 15 and passes through the upstream sleeve 16. The inlet pipe 19 is pierced with gas passage orifices 21.

The bell-shaped wall 14, 16 of the metering chamber 11 is secured to a moving plate 22 to which it is fixed, this plate being mounted so that it can move against the action of a return spring 23 bearing against an end wall 24 of the body 1 and a small axial tubular skirt 25 via an outer rim 26. This skirt 25 is pressed firmly against the moving plate 22 by the spring 23 but against the action of another spring 27 bearing against the moving plate 22 and an interior rim 28 of this small skirt 25. It is in a central recess of the moving plate 22 that the tubular wall 14 and the sleeve 16 of the metering chamber 11 are mounted.

The second chamber 12 for preparing the air-gas mixture is designed to communicate with the metering chamber 11 via the inlet and delivery pipe 19 of the metering chamber 11, its inlet pipe 20 and the three-way directional control valve 17. This second chamber 12 is delimited by the fixed plate 15, constituting its upstream transverse wall, and a moving throttling plate 31 constituting its downstream transverse wall and which separates it from the third, throttling and propulsion, chamber, 13.

The throttling plate 31 is provided with orifices 37 for the passage of the mixture and for (quasi)tangentially ejecting this mixture into the third chamber 13, as described in greater detail hereinafter. The third, throttling and propulsion, chamber 13 is delimited by the upstream throttling plate 31 and, downstream, the piston head 6 and by a downstream wall portion 32 of the body 1 of the tool.

A valve shutter 33 is mounted in the fixed plate 15 and able to move against the action of a spring 34 to let air into the mixing chamber 12. An air inlet valve 35 letting air into the propulsion chamber 13 is mounted on the downstream wall portion 32 and can be actuated by a trigger 36 mounted on the operating hand grip 2.

The way in which the tool works will now be described.

Figure 2:
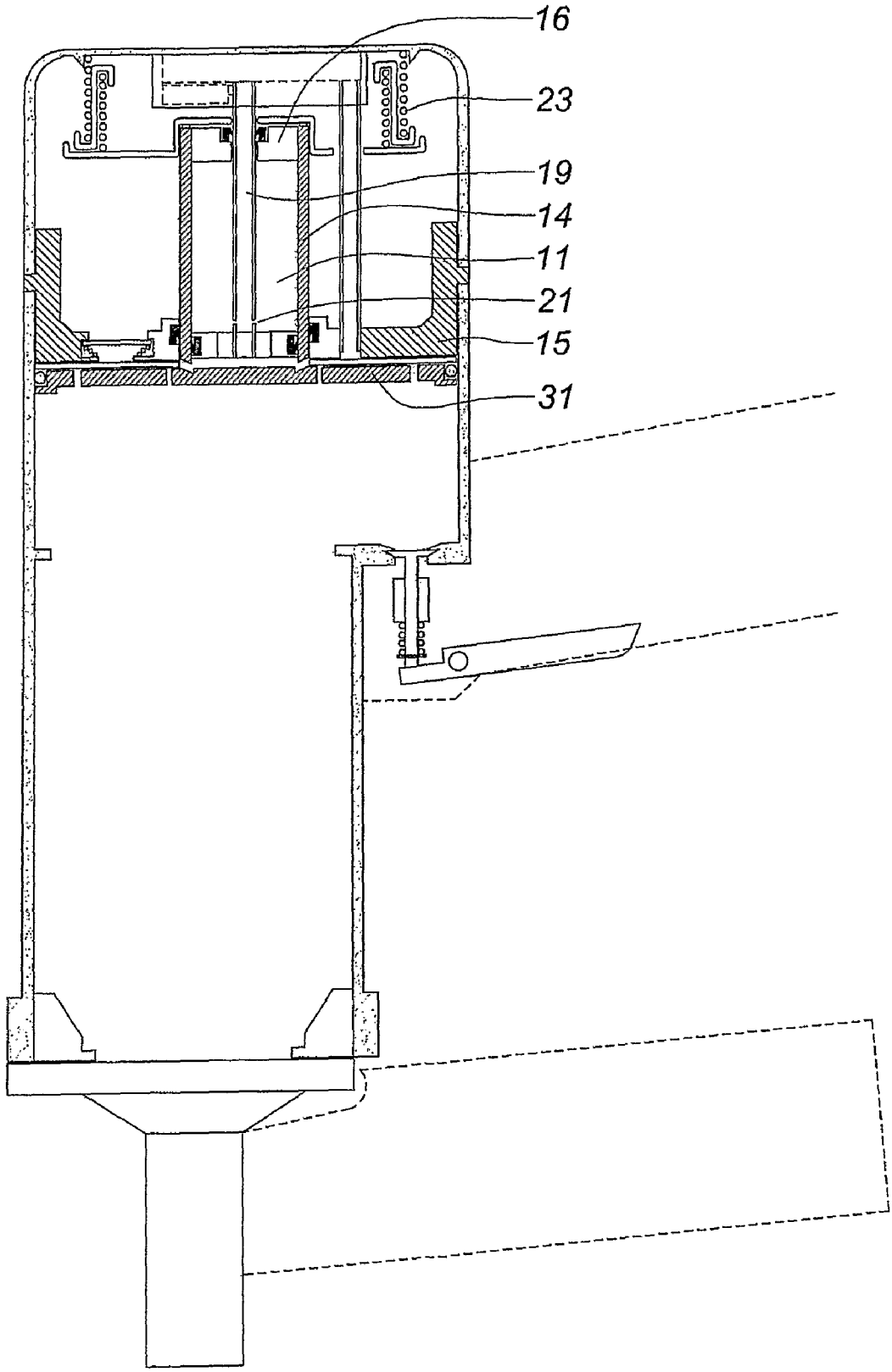
FIG. 2 is a depiction in axial section of the tool of FIG. 1, at the end of filling of the metering chamber.

With reference to FIG. 1, the directional control valve 17 is in a position in which, with the inlet port 18 connected to a gas cartridge, the pressurized gas from the cartridge is let by the pipe 19 and the orifices 21 into the metering chamber 11 and pushes the piston 16 upstream to fill the chamber 11 while at the same time compressing the spring 23 until the moving throttling plate 31 secured to the bell-shaped wall 14, 16 of the metering chamber 11 comes into abutment against the fixed plate 15 and the chamber 11 contains the correct amount of gas for a firing (FIG. 2).

Figure 3:
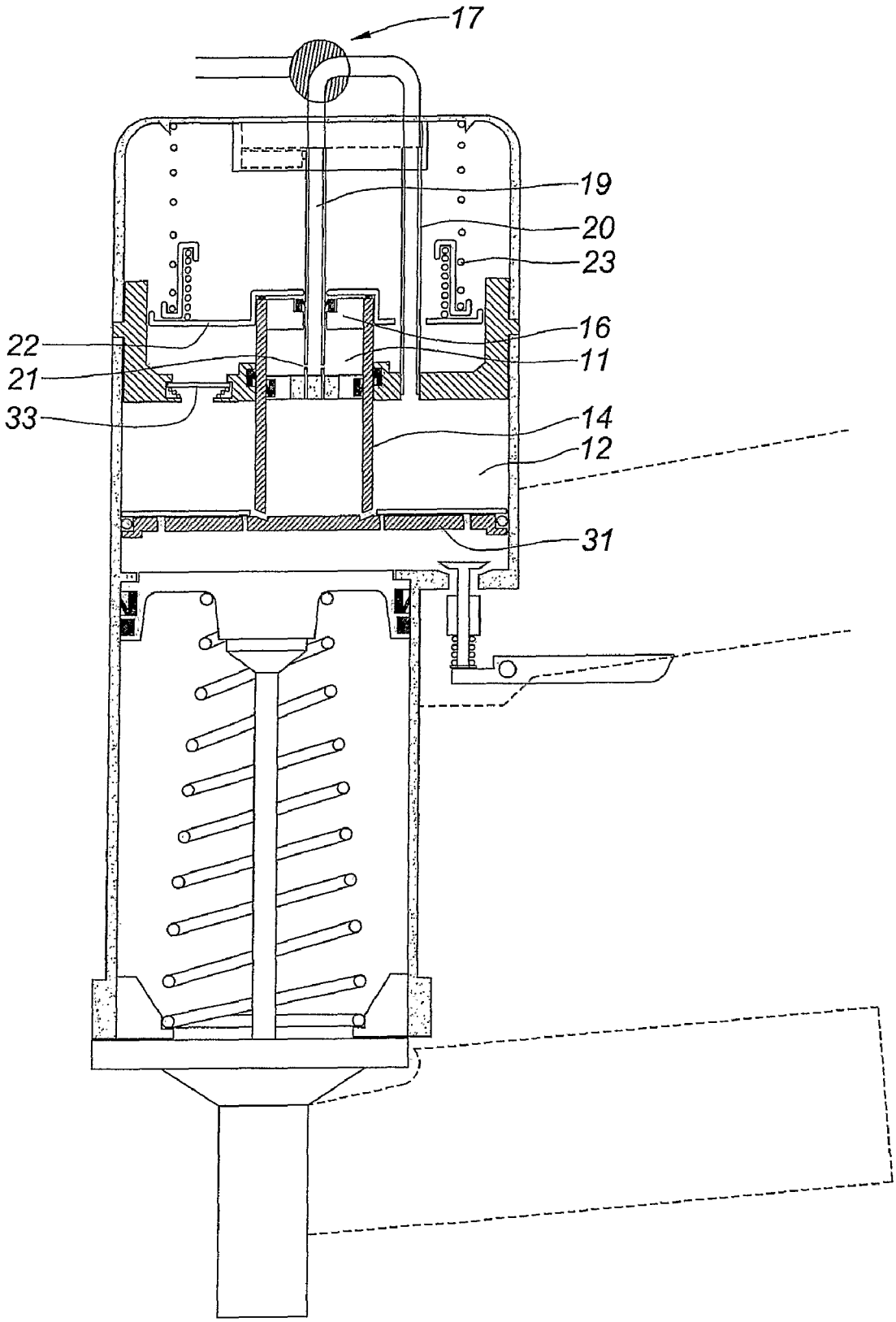
FIG. 3 is a depiction in axial section of the tool of FIG. 1, in the process of filling the air-gas mixing chamber.

With reference to FIG. 3, the position of the directional control valve 17 has changed, to close off the arrival of gas from the cartridge into the metering chamber 11 and allow gas to be transferred from the metering chamber 11 into the mixing chamber 12 through the orifices 21 and the pipe 19, this time acting as a delivery pipe, and the inlet pipe 20 of the mixing chamber 12. This being the case, as the metering chamber 11 empties, the spring 23 relaxes, pushing back the moving plate 22, the bell-shaped wall 14, 16 and the throttling plate 31. At the same time, via the valve shutter 33, the mixing chamber 12 also fills with an appropriate volume of air.

Figure 4:
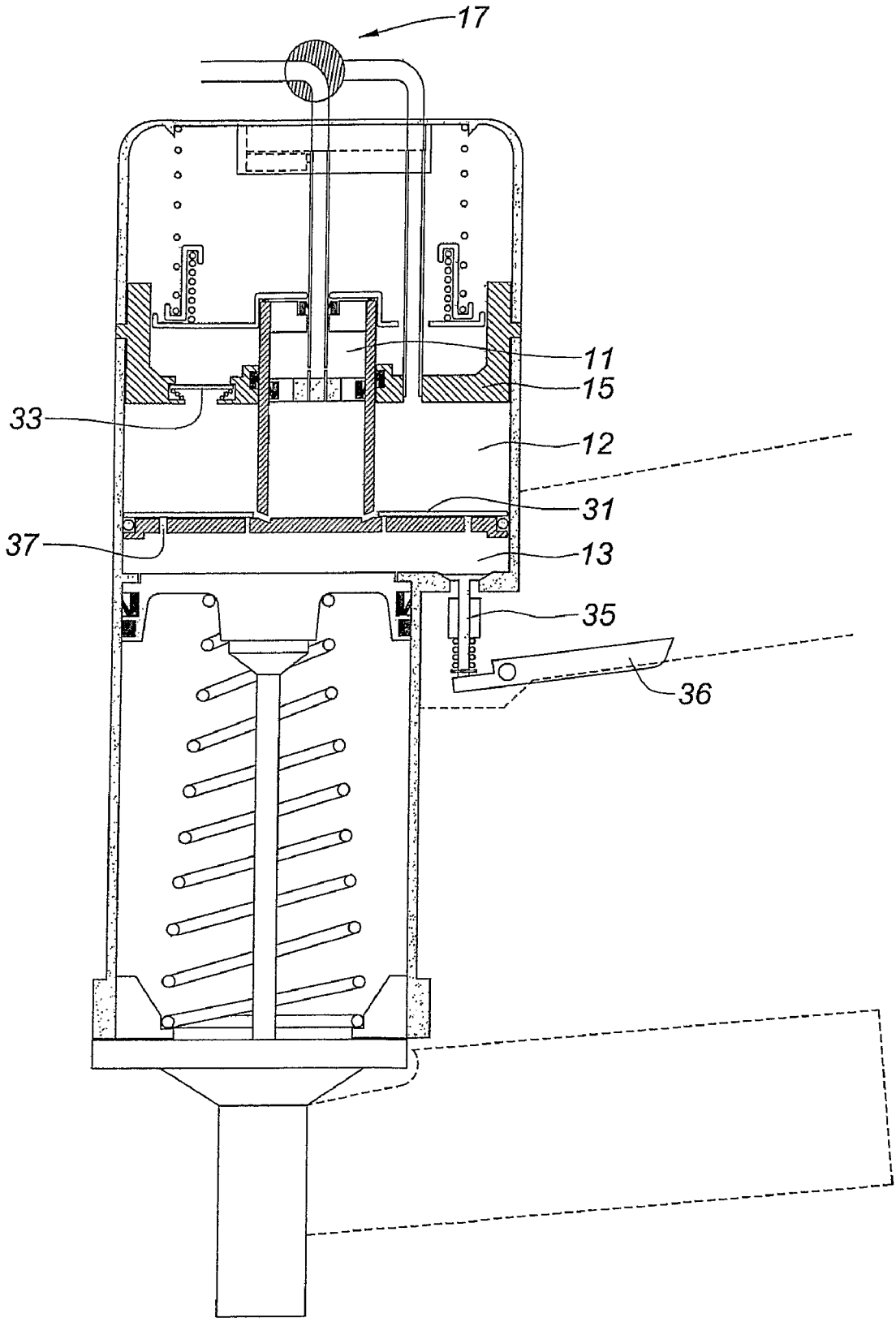
FIG. 4 is a depiction in axial section of the tool of FIG. 1, in the process of filling the throttling and propulsion chamber.
Figure 5:
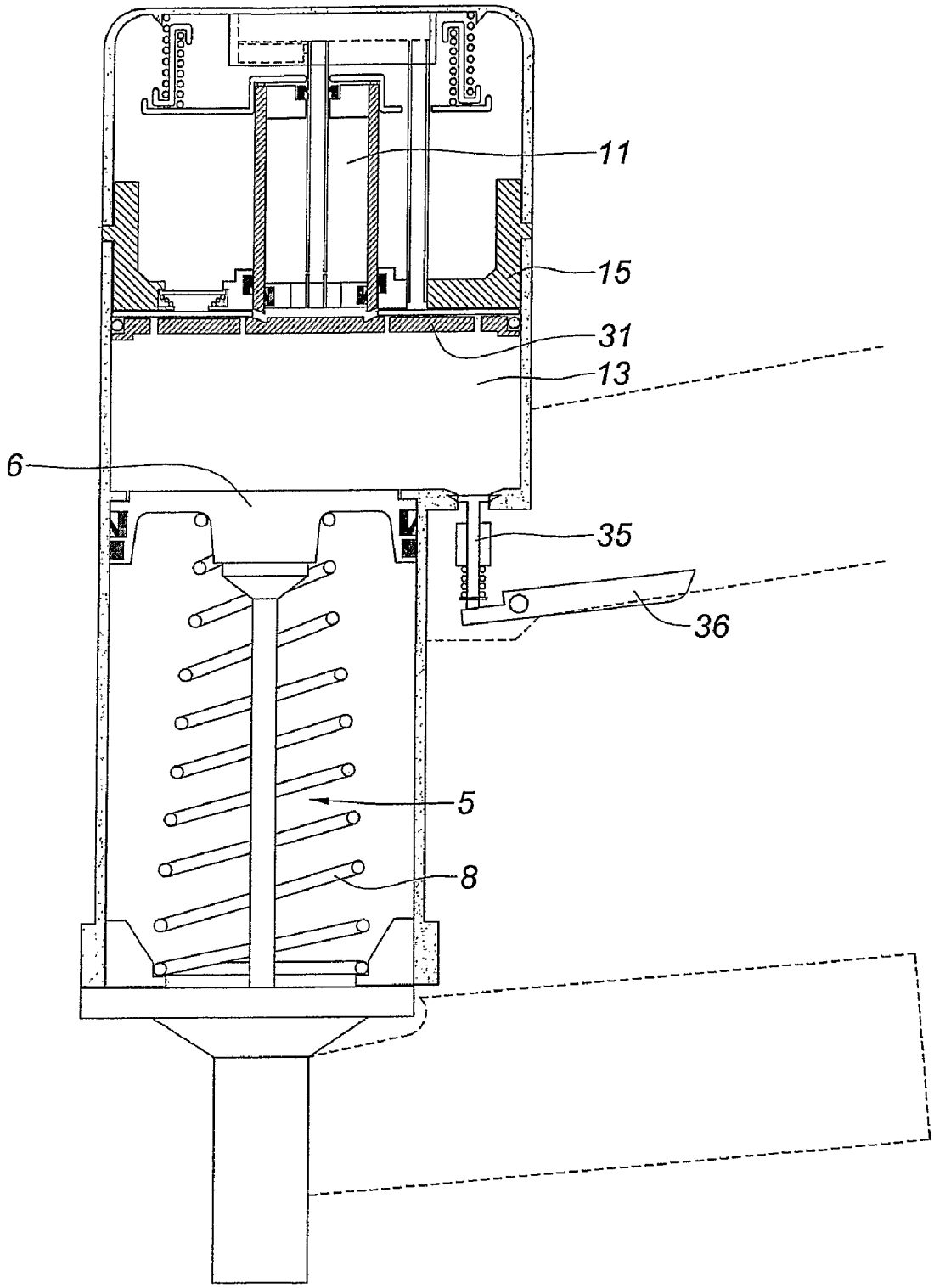
FIG. 5 is a depiction in axial section of the tool of FIG. 1, ready for firing.

With reference to FIG. 4, the valve 35 is actuated using the trigger 36 and the position of the directional control valve 17 is changed once again to allow gas to be admitted into the metering chamber 11 for the next firing, and this drives the throttling plate 31 towards the fixed plate 15. The valve shutter 33 and the valve 35 are in their closed positions so the upstream moving of the throttling plate 31 forces the air-gas mixture from the mixing chamber 12 to pass, through the ejection orifices 37, into the throttling and propulsion chamber 13. Because the mixture is ejected (quasi)tangentially into the chamber 13, the mixture spreads out therein in strata or layers, particularly favourable to excellent combustion. When the throttling piston 31 comes into abutment against the fixed plate 15 (FIG. 5) the ignition equipment is operated for firing. Upon firing, the piston 5 is driven in the downstream direction (towards the front of the tool) and its head 6 moves past a discharge valve (not depicted) and is then returned rearwards by the spring 8.

The following firing sequence continues with reference to FIG. 3 and subsequent.

Figure 6:
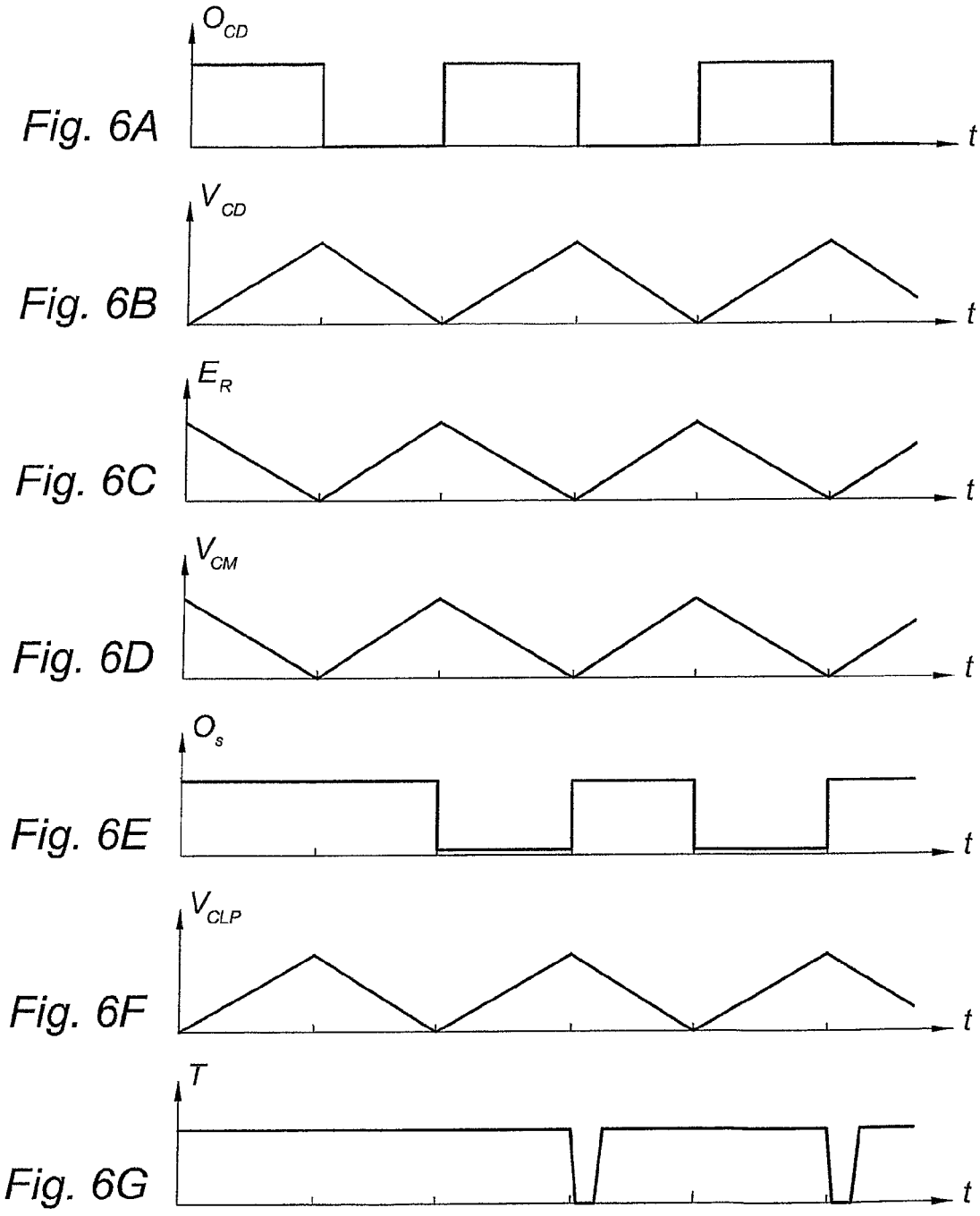
FIG. 6 is a set of histograms illustrating the operation of the tool of FIGS. 1 to 5.

The way in which the tool works can be illustrated by the histograms of FIG. 6.

FIG. 6A depicts the periods of opening and of closure $O_{CD}$ of the metering chamber 11 with respect to the gas cartridge. FIG. 6B represents the variation in volume $V_{CD}$ of the metering chamber 11. During the open periods, the volume increases. Outside of these open periods the volume decreases. FIG. 6C represents the extension $E_R$ of the return spring 23 that returns the moving plate 22 secured to the bell-shaped wall 14, 16 of the metering chamber 11. During the open periods this volume decreases and outside of these periods it increases, unlike the volume $V_{CD}$ of the metering chamber. FIG. 6E represents the periods of opening and of closure $O_S$ of the valve 35. It remains in an open position throughout the first opening-closing cycle of the metering chamber 11 until the trigger 36 is first actuated, then finds itself in a closed position throughout the periods of opening of the metering chamber. FIG. 6F represents the variation in volume $V_{CLP}$ of the throttling and propulsion chamber 13 which varies like the volume $V_{CD}$ of the metering chamber 11. Finally, FIG. 6G represents the cycles of firing T, the first occurring at the end of the open period of the second period of the metering chamber, the others at the end of each open period.

Figure 7:
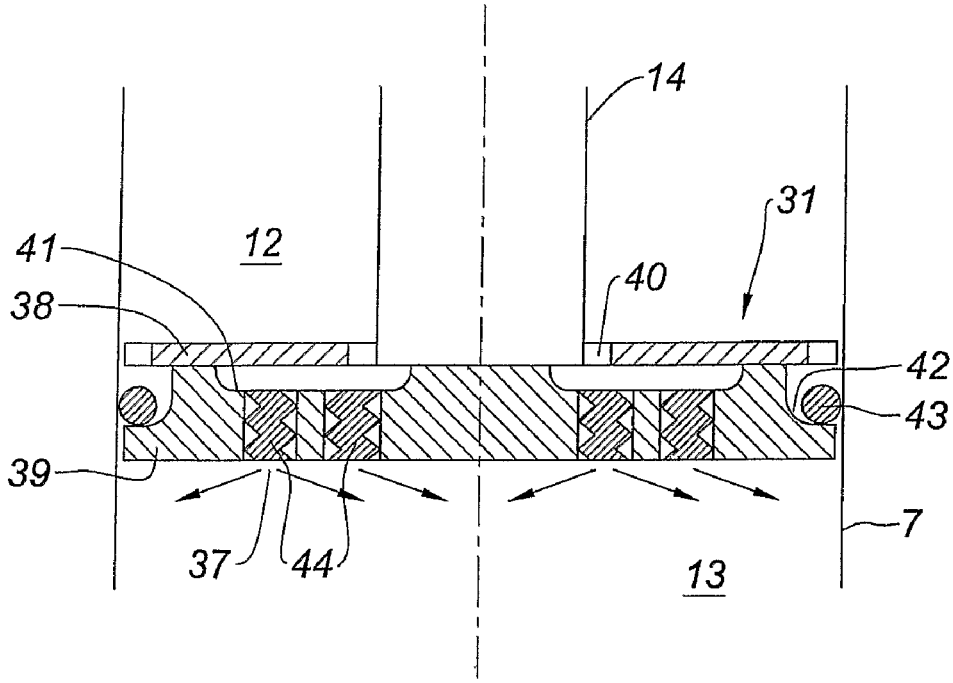
FIG. 7 is a schematic view in axial section of the moving plate for throttling the air-gas mixture which plate separates the second and third chambers of the tool.
Figure 8:
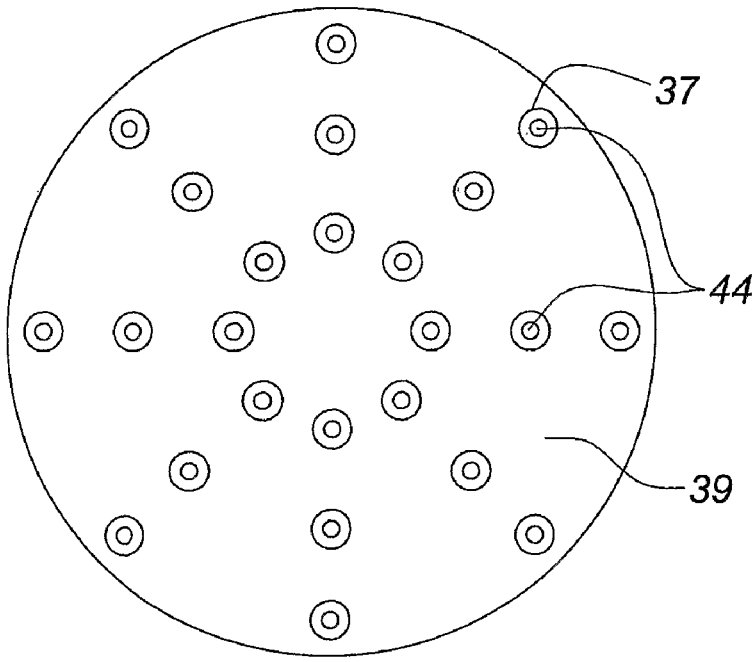
FIG. 8 is a view from beneath of the throttling plate of FIG. 7.

With reference to FIGS. 7 and 8, the throttling plate 31 comprises, on the same side as the mixing chamber 12, a disk 38 to which there is secured, on the same side as the throttling and propulsion chamber 13, a throttling plate 39, pierced with the orifices for the passage of the mixture 37. The disk 38, of a cross section corresponding to the internal cross section of the chamber 12, is secured to the tubular wall 14. Against this wall there are formed, in the thickness of the disk 38, openings 40 for the passage of the mixture communicating with the upstream side of the plate 39. An annular cup 41 is formed on the upstream side of the plate 39 to form, with the disk 38 and its passage openings 40, a comb for distributing the mixture across the plate 39. The tubular wall 14 rests on the central part of the plate 39. A peripheral annular shoulder 42 is formed on the plate 39 to accept an annular sealing ring 43. The throttling of the mixture is created in the throttling and propulsion chamber 13 by the tangential ejection of the mixture from orifices 37 on the chamber 13 side. This tangential ejection is brought about by a vortex effect through the passage orifices 37 here created by a threaded component 44, of the screw type, positioned in each orifice 37.

The invention claimed is:

1. An internal-combustion gas-powered hand tool comprising:

a first chamber configured to meter fuel gas;

a second chamber configured to communicate with the first chamber and prepare mixture of the fuel gas from the first chamber and air; and a third chamber configured to communicate with the second chamber and to propel a piston by firing the mixture of the fuel gas and the air from the second chamber, wherein the first chamber, second chamber, and the third chamber are configured to concurrently throttle the mixture of the fuel gas and the air from the second chamber to the third chamber and allow fuel gas for next firing entering the first chamber.

2. The gas-powered hand tool according to claim 1, wherein the second and third chambers are separated by a moving plate for throttling the mixture.

3. The gas-powered hand tool according to claim 2, wherein the moving plate is equipped with a means for ejecting the mixture into the third chamber.

4. The gas-powered hand tool according to claim 3, wherein the ejecting means comprises a means for creating a vortex effect.

5. The gas-powered hand tool according to claim 2, wherein the moving plate comprises a disk and a plate secured to one another and configured to form a comb for distributing the air-gas mixture.

6. The gas-powered hand tool according to claim 1, further comprising a three-way directional control valve in which a gas inlet port and two ports open respectively onto the first chamber and the second chamber, the three-way directional control valve being configured to allow a connection between the gas inlet and the first chamber or a connection between the first chamber and the second chamber.

7. The gas-powered hand tool according to claim 1, wherein the first chamber is delimited by a bell-shaped wall mounted to slide, on a fixed plate delimiting the second chamber.

8. The gas-powered hand tool according to claim 7, in which the first chamber is secured to a moving plate fixed to the bell-shaped wall and subjected to the action of a return means for providing a force against pressurized gas from a gas inlet.

9. The gas-powered hand tool according to claim 1 is a securing tool where the piston is configured to strike a fastener.

10. A gas-powered hand tool comprising:

a means for metering fuel gas;

a gas inlet configured to convey the fuel gas to the metering means;

a means for preparing mixture of the fuel gas from the metering means and air;

a means for selectively connecting at least the gas inlet with the metering means or the metering means with the mixture-preparing means;

a means for throttling the mixture of the fuel gas and the air, receiving the mixture of the fuel gas and the air from the mixture-preparing means, and propelling a piston.

* * * * *